US012044513B2

(12) United States Patent
Dixon et al.

(10) Patent No.: US 12,044,513 B2
(45) Date of Patent: Jul. 23, 2024

(54) PASSIVELY JETTISONED CONTROL SURFACE RESTRAINT AND COVER FOR TACTICAL FLIGHT VEHICLES

(71) Applicant: Raytheon Company, Tewksbury, MA (US)

(72) Inventors: Jason Allan Dixon, Tucson, AZ (US); Kenyon Kehl, Tucson, AZ (US); Edgar R. Melkers, Tucson, AZ (US); Randall S. Firor, Tucson, AZ (US)

(73) Assignee: Raytheon Company, Tewksbury, MA (US)

( * ) Notice: Subject to any disclaimer, the term of this patent is extended or adjusted under 35 U.S.C. 154(b) by 0 days.

(21) Appl. No.: 17/829,799

(22) Filed: Jun. 14, 2022

(65) Prior Publication Data

US 2023/0400285 A1 Dec. 14, 2023

(51) Int. Cl.
*F42B 10/64* (2006.01)

(52) U.S. Cl.
CPC ..... *F42B 10/64* (2013.01)

(58) Field of Classification Search
CPC ..... F42B 10/64; B64C 13/14
See application file for complete search history.

(56) References Cited

U.S. PATENT DOCUMENTS 3,563,466 A 2/1971 Clark et al.
3,861,272 A 1/1975 Koepfer
3,916,560 A * 11/1975 Becker ..... A63H 27/14 446/65
6,723,972 B2 * 4/2004 Schroeder ..... F02K 1/008 244/3.24
6,880,780 B1 * 4/2005 Perry ..... F42B 10/14 244/49

(Continued)

FOREIGN PATENT DOCUMENTS

WO 2023234994 12/2023

OTHER PUBLICATIONS

International Search Report and Written Opinion for related International Application No. PCT/US2023/015717, mailed Jun. 15, 2023.

(Continued)

*Primary Examiner* — Richard Green
*Assistant Examiner* — Nevena Aleksic
(74) *Attorney, Agent, or Firm* — Schwegman Lundberg & Woessner, P.A.

(57) ABSTRACT

A system for restraining one or more control surfaces of a tactical flight vehicle includes a retaining frame secured at an aft end of the tactical flight vehicle and a cover plate releasably coupled to the retaining frame with a resilient lock ring. The resilient lock ring is disposed between the retaining frame and the cover plate and is deformable between a locking configuration and an unlocking configuration. A control surface restraining ring is releasably coupled to the cover plate and has control surface restraints configured to engage respective control surfaces. The resilient lock ring is configured to deform from the locking configuration to the unlocking configuration upon a launch of the tactical flight vehicle such that the cover plate becomes uncoupled from the retaining frame and may be jettisoned from the tactical flight vehicle after the launch.

14 Claims, 5 Drawing Sheets

(56) References Cited

U.S. PATENT DOCUMENTS

| | | | | |
|---|---|---|---|---|
| 6,978,967 | B1 * | 12/2005 | Scheper | F42B 10/16 102/385 |
| 7,316,370 | B2 | 1/2008 | Sankovic et al. | |
| 8,686,328 | B2 | 4/2014 | Bugge et al. | |
| 10,655,665 | B2 | 5/2020 | Balsells | |
| 11,150,062 | B1 * | 10/2021 | Jankowski | F42B 10/64 |
| 2004/0021034 | A1 * | 2/2004 | Hellman | F42B 10/14 244/3.28 |
| 2006/0278754 | A1 * | 12/2006 | Sankovic | F42B 10/64 244/3.27 |
| 2011/0180655 | A1 * | 7/2011 | Deschatre | F42B 10/14 244/3.28 |

OTHER PUBLICATIONS

The pending claims of co-pending U.S. Appl. No. 17/466,210, filed Sep. 3, 2021.

* cited by examiner

PASSIVELY JETTISONED CONTROL SURFACE RESTRAINT AND COVER FOR TACTICAL FLIGHT VEHICLES

TECHNICAL FIELD

The present disclosure relates generally to tactical flight vehicles and more particularly to control surface restraining systems for tactical flight vehicles.

BACKGROUND

Tactical flight vehicles, such as missiles and rockets, often have one or more control surfaces, such as tail fins, elevators, ailerons, elevons, rudders, flaps, slats, etc. Such control surfaces are mounted to the tactical flight vehicle and controlled by a control actuation system for controlling a flight path of the tactical flight vehicle. Tactical flight vehicles that are, for example, launched from environments having vibratory influences, have adjacent flight vehicle launches, or are air-launched, typically require a control surface restraint to keep the control surfaces aligned along the longitudinal axis. Such alignment is important for adjacent storage clearance, lower drag on the carrying aircraft, and to keep the control fins aligned at a "zero-position" for calibration of a control actuation system before initialization. Additionally, in order to load the tactical flight vehicle into the carrying aircraft, the control surfaces must be able to be rotated to make room for a loading strap to wrap around the tactical flight vehicle for handling. After loading the tactical flight vehicle into the carrying aircraft, the control surfaces must be able to be rotated back and held constant at the "zero-position" for proper control actuation system initialization.

Prior attempts to provide such a control surface restraint have involved actively actuated mechanisms that use power and wiring, thus requiring extra internal storage space in order to implement their functionality. Additionally, conventional control actuation system designs may not allow for mechanical locks or stops, which are needed to ensure proper egress of the missile from the launch platform, to be a part of the actuator assembly or located internal to the control actuation system. Conventional passive mechanisms, on the other hand, impact the size and mass of the missile, and require a complex release mechanism, or are otherwise carried on the missile for the entire mission.

SUMMARY

An improved, light weight, tightly packaged, and passive control surface restraining system is disclosed herein. The passive control surface restraining system is secured to an aft end of a tactical flight vehicle, for example on the outer mold line of the control actuation system and consists of multiple parts made from lightweight materials to reduce the overall assembly mass and part count. Part of the passive control surface restraining system may be quickly and easily removed to facilitate manual control surface rotation, for example for loading the tactical flight vehicle, and re-installed to capture and maintain the control surface(s) at a desired position (e.g., the "zero position"). Additionally, upon launch of the tactical flight vehicle, at least the part of the passive control surface restraining system that captures and maintains the control surface(s) may be released (i.e., jettisoned) from the tactical flight vehicle. As the passive control surface restraining system described herein is compact, the impact to the outer mold line of the tactical flight vehicle as a whole is minimized and the overall thickness of the restraining system is packaged much smaller than a conventional passive, mechanically released device.

According to an aspect of this disclosure, a control surface restraining system for restraining one or more control surfaces of a tactical flight vehicle includes a retaining frame secured at an aft end of the tactical flight vehicle and a cover plate releasably coupled to the retaining frame with a resilient lock ring. The resilient lock ring is disposed between the retaining frame and the cover plate. The resilient lock ring is deformable between a locking configuration for coupling the cover plate to the retaining frame, and an unlocking configuration for uncoupling the cover plate from the retaining frame. The control surface restraining system also includes a control surface restraining ring releasably coupled to the cover plate and having one or more control surface restraints configured to engage a respective one of the one or more control surfaces of the tactical flight vehicle when the control surface restraining ring is coupled to the cover plate and the cover plate is coupled to the retaining frame. The resilient lock ring is configured to deform from the locking configuration to the unlocking configuration upon a launch of the tactical flight vehicle such that the cover plate becomes uncoupled from the retaining frame and may be jettisoned from the tactical flight vehicle after the launch.

According to an embodiment of any paragraph(s) of this disclosure, the retaining frame is annular and is secured around a periphery of the aft end of the tactical flight vehicle.

According to another embodiment of any paragraph(s) of this disclosure, the retaining frame is secured to the aft end of the tactical flight vehicle with one or more frame fasteners.

According to another embodiment of any paragraph(s) of this disclosure, the cover plate includes a retaining frame coupling groove arranged concentrically within a periphery of the cover plate on a first face of the cover plate, the first face of the cover plate opposing the aft end of the tactical flight vehicle, for receiving the retaining frame when the cover plate is coupled to the retaining frame.

According to another embodiment of any paragraph(s) of this disclosure, the resilient lock ring is disposed between a radially inner surface of the retaining frame and a first opposing wall of the retaining frame coupling groove of the cover plate.

According to another embodiment of any paragraph(s) of this disclosure, the resilient lock ring is disposed at least partially in a lock ring groove on the first opposing wall of the retaining frame coupling groove of the cover plate.

According to another embodiment of any paragraph(s) of this disclosure, the control surface restraining system also includes a seal disposed between a radially outer surface of the retaining frame and a second opposing wall of the retaining frame coupling groove of the cover plate.

According to another embodiment of any paragraph(s) of this disclosure, the seal is disposed at least partially in a seal groove on the radially outer surface of the retaining frame.

According to another embodiment of any paragraph(s) of this disclosure, the control surface restraining ring is releasably coupled to the cover plate with one or more restraining ring fasteners.

According to another embodiment of any paragraph(s) of this disclosure, the one or more restraining ring fasteners includes a quick release pull-pin fastener.

According to another embodiment of any paragraph(s) of this disclosure, each of the one or more control surface restraints includes a control surface notch for engaging the respective one of the one or more control surfaces of the tactical flight vehicle.

According to another embodiment of any paragraph(s) of this disclosure, a width of the control surface notch of each of the one or more control surface restraints is greater than a thickness of the one or more control surfaces.

According to another aspect of this disclosure, a method of restraining one or more control surfaces of a tactical flight vehicle includes the steps of securing a retaining frame to an aft end of the tactical flight vehicle and coupling a cover plate to the retaining frame with a resilient lock ring disposed between the retaining frame and the cover plate. The method also includes the step of coupling a control surface restraining ring to the cover plate. The control surface restraining ring has one or more control surface restraints configured to engage a respective one of the one or more control surfaces of the tactical flight vehicle.

According to an embodiment of any paragraph(s) of this disclosure, the securing the retaining frame to the aft end of the tactical flight vehicle includes securing the retaining frame with one or more frame fasteners.

According to another embodiment of any paragraph(s) of this disclosure, the coupling the cover plate to the retaining frame with the resilient lock ring includes installing the resilient lock ring on a radially inner surface of the retaining frame and receiving the retaining frame and the resilient lock ring into a retaining frame coupling groove arranged concentrically within a periphery of the cover plate on a first face of the cover plate. The first face of the cover plate opposes the aft end of the tactical flight vehicle. The resilient lock ring is therefore disposed between the radially inner surface of the retaining frame and a first opposing wall of the retaining frame coupling groove of the cover plate, and is disposed at least partially in a lock ring groove on the first opposing wall of the retaining frame coupling groove of the cover plate.

According to another embodiment of any paragraph(s) of this disclosure, the coupling the control surface restraining ring to the cover plate includes releasably fastening the control surface restraining ring to the cover plate with one or more restraining ring fasteners.

According to another embodiment of any paragraph(s) of this disclosure, the one or more restraining ring fasteners include a quick release pull-pin fastener and the releasably fastening includes pulling the quick release pull-pin fastener to permit receipt of the retaining frame and the resilient lock ring into the retaining frame coupling groove, and releasing the quick release pull-pin fastener such that the quick release pull-pin fastener engages a fastening groove on a radially outer surface of the cover plate, thereby coupling the control surface restraining ring to the cover plate.

According to another embodiment of any paragraph(s) of this summary, the method also includes installing a seal between a radially outer surface of the retaining frame and a second opposing wall of the retaining frame coupling groove of the cover plate such that the seal is disposed at least partially in a seal groove on the radially outer surface of the retaining frame.

According to another embodiment of any paragraph(s) of this summary, each of the one or more control surface restraints include a control surface notch and the method further includes engaging a respective one of the one or more control surfaces of the tactical flight vehicle with the control surface notch.

According to another embodiment of any paragraph(s) of this summary, the method further includes restraining the one or more control surfaces of the tactical flight vehicle within the control surface notch of the one or more control surface restraints.

The following description and the annexed drawings set forth in detail certain illustrative embodiments described in this disclosure. These embodiments are indicative, however, of but a few of the various ways in which the principles of this disclosure may be employed. Other objects, advantages and novel features will become apparent from the following detailed description when considered in conjunction with the drawings.

BRIEF DESCRIPTION OF DRAWINGS

The annexed drawings show various aspects of the disclosure.

DETAILED DESCRIPTION

Figure 1:
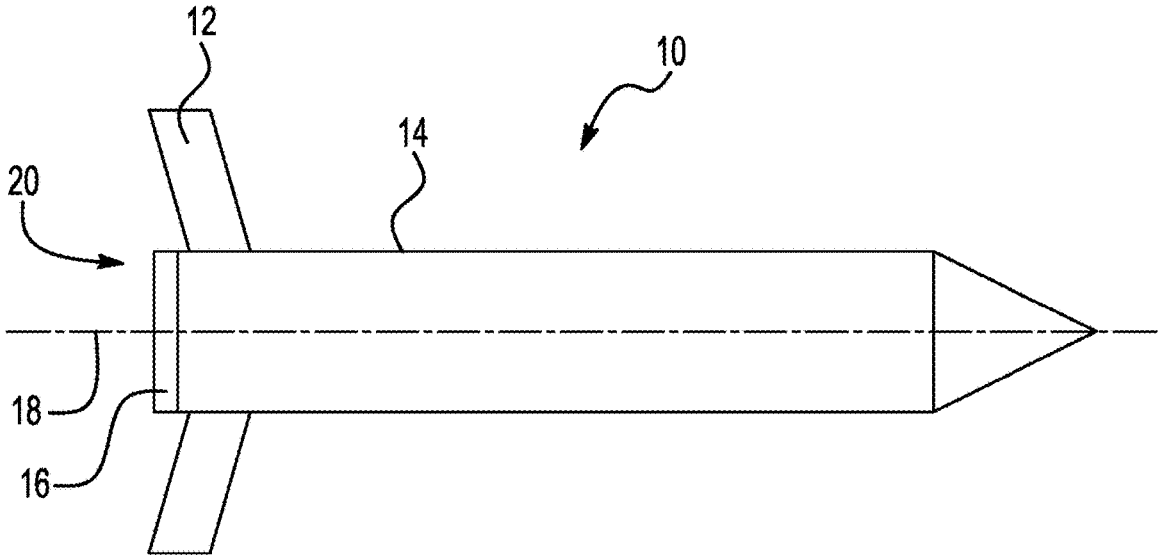
FIG. 1 is a general schematic of a tactical flight vehicle having a control surface restraining system thereon.

According to a general embodiment, a control surface restraining system for variably restraining a control surface on a tactical flight vehicle is described. With reference to FIG. 1, a general schematic of a tactical flight vehicle 10 is depicted. The tactical flight vehicle 10 may be, for example, a missile or a rocket. The tactical flight vehicle 10 includes at least one control surface 12 mounted to the tactical flight vehicle 10, for example, on an airframe 14 of the tactical flight vehicle 10. In the embodiment shown and described herein, the at least one control surface 12 is a tail fin. It is understood, however, that aspects of this disclosure may be applicable to other types of control surfaces, such as elevators, ailerons, elevons, rudders, flaps, slats, etc. The tactical flight vehicle 10 includes a control surface restraining system 16 located at an aft end 20 of the tactical flight vehicle 10. The control surface restraining system 16 is configured to restrain the control surface 12 and maintain the control surface 12 in a "zero position" (i.e., aligned with a longitudinal axis 18 of the tactical flight vehicle 10) prior to launch of the tactical flight vehicle 10 and initialization of the control actuation system. The control surface restraining system 16 also allows for temporary manual rotation of the control surface 12 out of the "zero position" for handling and loading the tactical flight vehicle 10 into a carrying aircraft. Upon launch of the tactical flight vehicle 10, the control surface restraining system 16 is passively triggered, causing an automatic (i.e., requiring no active stimulus from the guidance section, power, or associated wiring) release of the control surface 12 such that the control actuation system can control the control surface 12 thereafter during flight of the tactical flight vehicle 10.

Now turning to FIGS. 2A-6, the control surface restraining system 16 includes a retaining frame 22, a cover plate 24 and a control surface restraining ring 26. The retaining frame 22 may be made of a metal, such as aluminum. The cover plate 24 and the control surface restraining ring 26 may be made of a lightweight material, such as a thermoplastic (e.g., polyetheretherketone), polymer, or carbon reinforced plastic (CFRP). It is understood that these materials are provided as non-limiting examples, and that other materials may be applicable to the retaining frame 22, the cover plate 24 and the control surface restraining ring 26. The retraining frame 22 is configured to be secured to an aft end 20 of the tactical flight vehicle 10 (as depicted in, for example, FIGS. 4 and 5), and the cover plate 24 is configured to be releasably coupled to the retaining frame 22 with a resilient lock ring 28 (as depicted in, for example, FIGS. 3A-B and 6). That is, the resilient lock ring 28 is disposed between the retaining frame 22 and the cover plate 24. The resilient lock ring 28 is deformable between a locking configuration for coupling the cover plate 24 to the retaining frame 22, and an unlocking configuration for uncoupling the cover plate 24 from the retaining frame 22, as will be described in more detail below. The resilient lock ring 28 may be, for example, a spring.

A seal 30 may also be disposed between the retaining frame 22 and the cover plate 24, on a surface of the retaining frame 22 opposite a surface of the retaining frame 22 on which the resilient lock ring 28 is disposed, as will be described in more detail later with reference to the cross sections depicted in FIGS. 5 and 6. The seal 30 may be, for example, an o-ring seal and may be made of, for example, a fluorocarbon rubber.

The control surface restraining ring 26 is releasably coupled to the cover plate 24 with one or more restraining ring fasteners 32 (depicted in, for example, FIGS. 3A-6). The control surface restraining ring 26 has one or more control surface restraints 34 configured to engage a respective one of the one or more control surfaces 12 of the tactical flight vehicle 10 when the control surface restraining ring 26 is coupled to the cover plate 24 and the cover plate 24 is coupled to the retaining frame 22.

Figure 5:
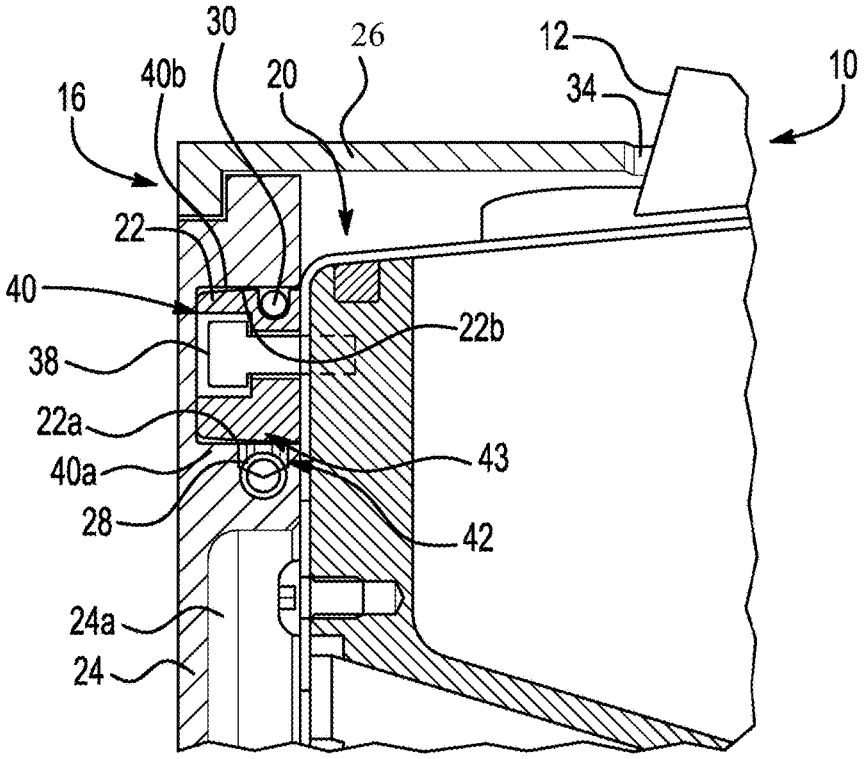
FIG. 5 is a cross sectional view of the control surface restraining system on a tactical flight vehicle.
Figure 6:
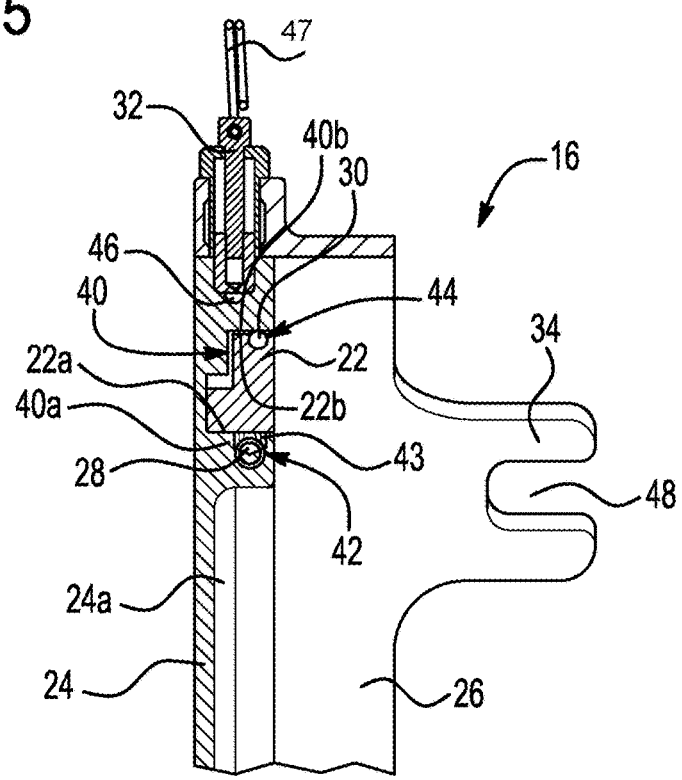
FIG. 6 is a cross sectional view of the control surface restraining system in isolation.

The retaining frame 22 may be annular and may be secured around a periphery of the aft end 20 of the tactical flight vehicle 10, as depicted best in FIG. 5. Specifically, the retaining frame 22 may be secured around a periphery of an aft face of the tactical flight vehicle 10. The retaining frame 22 may be secured to the aft end 20 of the tactical flight vehicle with one or more frame fasteners 38. The one or more frame fasteners 38 may be, for example, a bolt or a screw. The one or more frame fasteners 38 may include a plurality of frame fasteners 38 that may be spaced apart around the annular retaining frame 22. It is understood, however, that the examples of the one or more frame fasteners 38 described herein are provided as non-limiting examples, and other suitable fasteners may be applicable to the one or more frame fasteners 38 of the control surface restraining system 16.

Figure 2A:
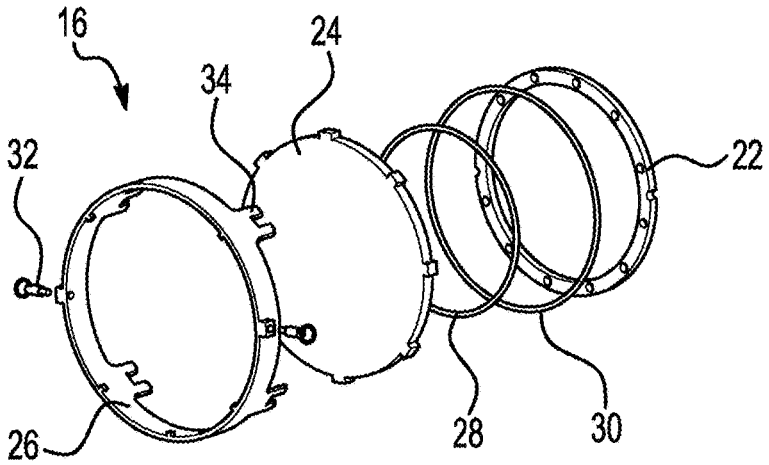
FIG. 2A is an exploded view of the control surface restraining system.
Figure 2B:
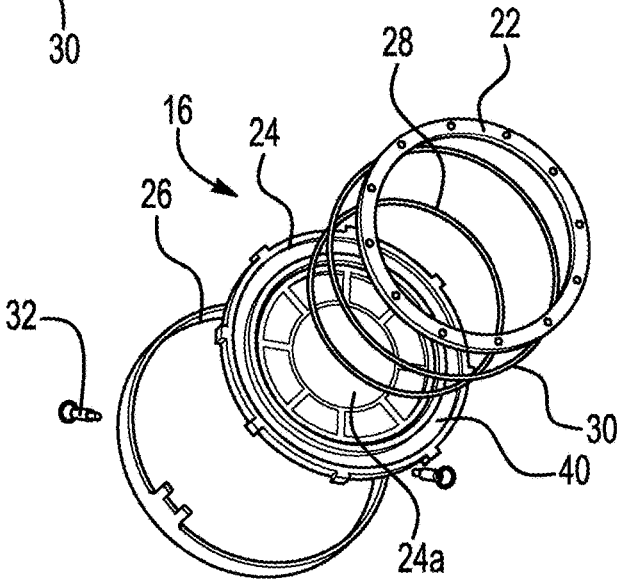
FIG. 2B is another exploded view of the control surface restraining system.
Figure 3A:
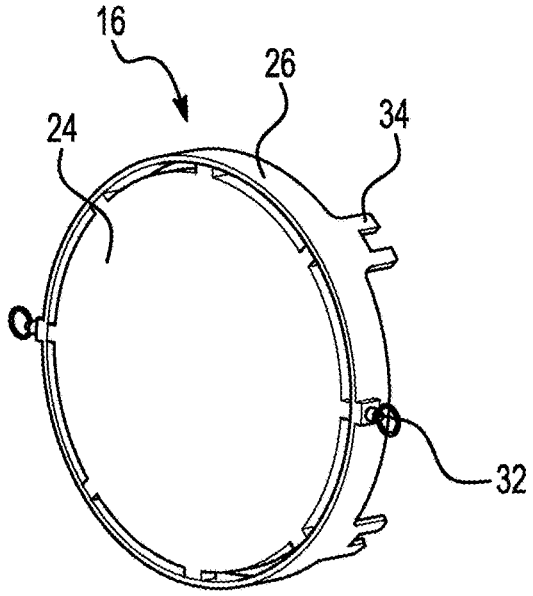
FIG. 3A is a perspective view of the control surface restraining system.
Figure 3B:
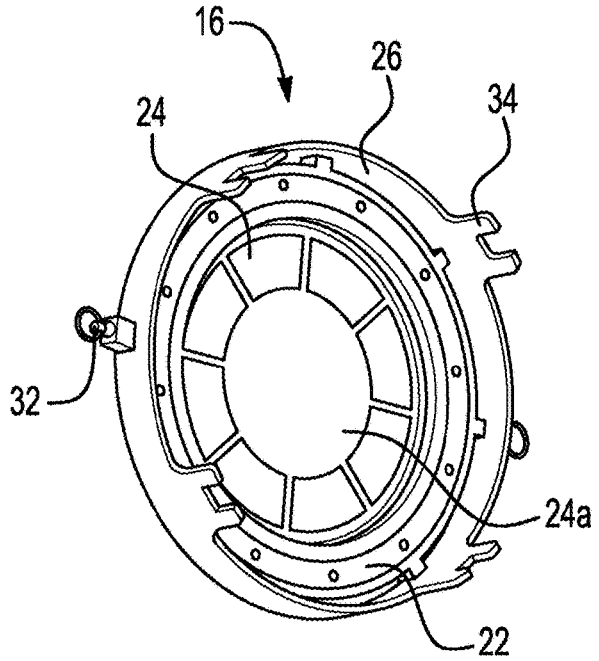
FIG. 3B is another perspective view of the control surface restraining system.
Figure 4:
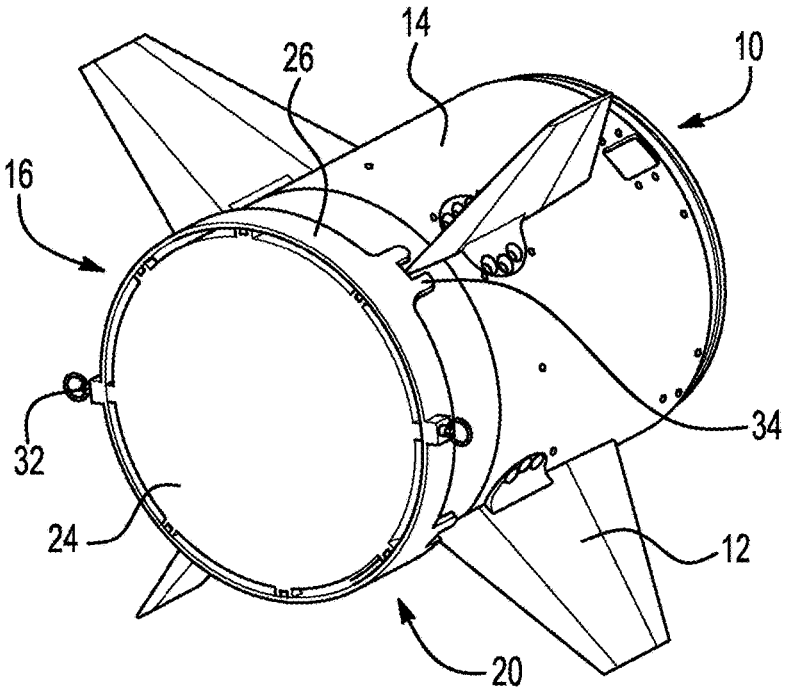
FIG. 4 is a perspective view of the control surface restraining system on a tactical flight vehicle.

As depicted in FIG. 2B, the cover plate 24 may include a retaining frame coupling groove 40 arranged concentrically within a periphery of the cover plate 24 on a first face **24*a* of the cover plate 24. The first face 24*a* of the cover plate 24 opposes the aft end (i.e., the aft face) of the tactical flight vehicle 10. As depicted in FIGS. 5 and 6, the retaining frame coupling groove 40 is configured to receive the retaining frame 22 when the cover plate 24 is coupled to the retaining frame 22. The resilient lock ring 28 and the seal 30 may be annular. When the cover plate 24 is coupled to the retaining frame 22, the resilient lock ring 28 is disposed between a radially inner surface 22*a* of the retaining frame 22 and a first opposing wall 40*a* of the retaining frame coupling groove 40 of the cover plate 24. For example, the resilient lock ring 28 may be disposed at least partially in a first lock ring groove 42 on the first opposing wall 40*a* of the retaining frame coupling groove 40 and at least partially in a second lock ring groove 43 on the radially inner surface 22*a* of the retaining frame 22. The seal 30 may be disposed between a radially outer surface 22*b* of the retaining frame 22 and a second opposing wall 40*b* of the retaining frame coupling groove 40. For example, the seal 30 may be disposed at least partially in a seal groove 44 on the radially outer surface 22*b* of the retaining frame 22**.

As mentioned above, the control surface restraining ring 26 is releasably coupled to the cover plate 24 with the one or more restraining ring fasteners 32. Specifically, the control surface restraining ring 26 may be releasably coupled to a radially outer surface of the cover plate 24. The one or more restraining ring fasteners 32 may be a quick release fastener, such as a pull-pin fastener, depicted in FIG. 6. The control surface restraining ring 26 may therefore have the one or more restraining ring fasteners 32 mounted thereon or extending therethrough, and the cover plate 24 may include one or more fastener recesses 46 formed on the radially outer surface of the cover plate 24 with which the one or more restraining ring fasteners 32 may engage to couple the control surface restraining ring 26 to the cover plate 24. The one or more restraining ring fasteners 32 may also have a pull tab 47 with which a user can pull the one or more restraining ring fasteners 32 to disengage the one or more restraining ring fasteners 32 from the fastener recess 46 so that the control surface restraining ring 26 may be released (uncoupled) from the cover plate 24. It is understood that the one or more restraining ring fasteners 32 described and depicted herein is provided as a non-limiting example, and that other suitable fasteners may be used as the one or more restraining ring fasteners 32 in the control surface restraining system 16 described herein.

As also mentioned briefly above, the control surface restraining ring 26 includes one or more control surface restraints 34. Each of the one or more control surface restraints 34 extend from the control surface restraining ring 26 toward the one or more control surfaces 12 of the tactical flight vehicle 10 when the control surface restraining ring 26 is coupled to the cover plate 24 and the cover plate 24 is coupled to the retaining frame 22 on the aft end 20 of the tactical flight vehicle 20. Each of the one or more control surface restraints 34 on the control surface restraining ring 26 include a control surface notch 48 for engaging a respective one of the one or more control surfaces 12 of the tactical flight vehicle 10. A width of each control surface notch 48 is greater than a thickness of the one or more control surfaces 12 such that an edge of the one or more control surfaces 12 may fit within and be held in position by the control surface notch 48. The width of the control surface notch 48 may be selected to allow for a specific degree of movement or rotation of the respective control surface 12 when engaged by the control surface notch 48 of the control surface restraint 34. For example, the width of the control surface notch 48 may be selected to allow for up to 3.1 degrees of rotation from the "zero position" of the respective control surface 12 when engaged by the control surface notch 48.

Figure 7:
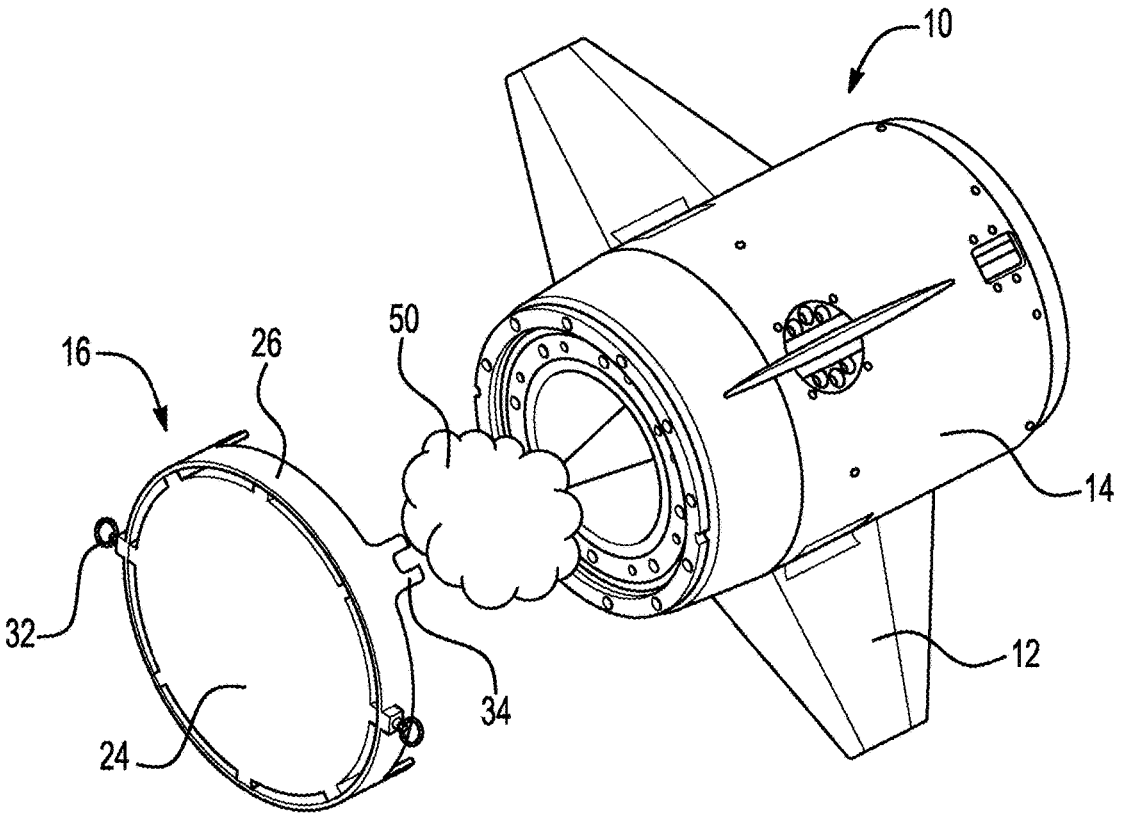
FIG. 7 is a perspective view of the control surface restraining system after a part of the control surface restraining system has been jettisoned from the tactical flight vehicle.

Turning to FIG. 7, operation of the control surface restraining system 16 will now be described. As described above, the cover plate 24 is releasably coupled to the retaining frame 22 and the control surface restraining ring 26 is releasably coupled to the cover plate 24. Accordingly, prior to launch of the tactical flight vehicle 10 having the control surface restraining system 16 thereon, a user may remove (uncouple) and recouple the control surface restraining ring 26, as appropriate, to facilitate free movement/adjustment of the one or more control surfaces 12 of the tactical flight vehicle 10. For example, the user may wish to move or adjust the one or more control surfaces 12 for loading and transport purposes. Prior to launch of the tactical flight vehicle 10, however, the user can recouple the control surface restraining ring 26 to the cover plate 24, which is coupled to the retaining frame 22, so that the one or more control surfaces 12 may be restrained at an appropriate position (e.g. the "zero position") for launch.

Figure 8A:
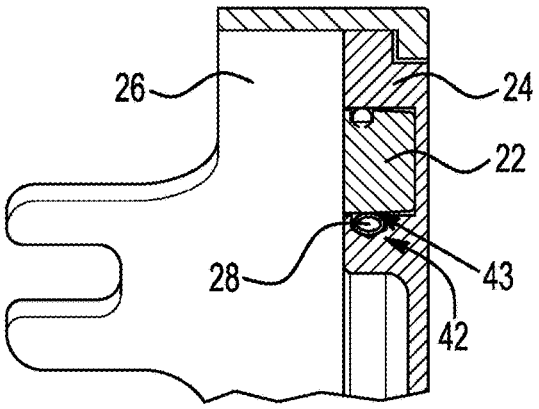
FIG. 8A is a cross sectional view of the control surface restraining system in a locking configuration.
Figure 8B:
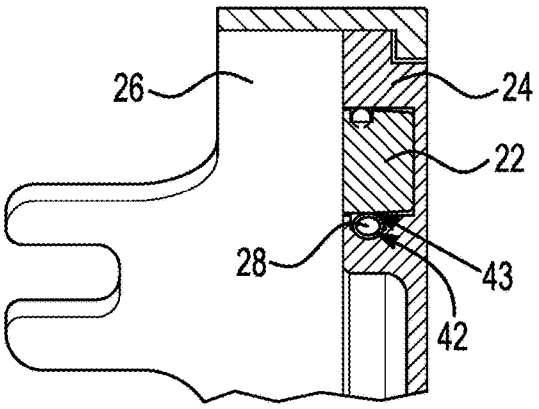
FIG. 8B is a cross sectional view of the control surface restraining system in an unlocking configuration.
Figure 9:
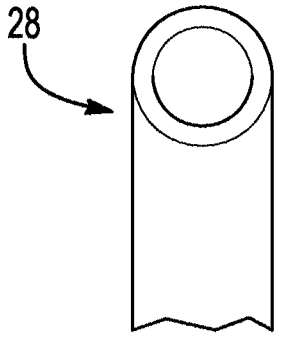
FIG. 9 is a cross sectional view of a resilient lock ring of the control surface restraining system in isolation.

Upon launch of the tactical flight vehicle 10, the cover plate 24 and the control surface restraining ring 26 coupled thereto, are configured to be passively jettisoned from the tactical flight vehicle 10 so that the one or more control fins 12 are free to move according to flight controls of the tactical flight vehicle 10. Specifically, the resilient lock ring 28 is configured to deform upon action by ignition pressure forces 50 when the tactical flight vehicle 10 is launched. That is, with additional reference to FIGS. 8A-B, the ignition pressure forces 50 are sufficient to deform the resilient lock ring 28 from the locking configuration (FIG. 8A), in which the resilient lock ring 28 couples the cover plate 24 and the retaining ring 22, to the unlocking configuration (FIG. 8B). In the unlocking configuration (FIG. 8B), the resilient lock ring 28 is deformed such that it escapes the second lock ring groove 43 and permits the cover plate 24 to release from (uncouple from) the retaining ring 22, after which the resilient lock ring 28 may return to its resting (uncompressed) geometry, having a circular cross section (FIG. 9). The resiliency of the resilient lock ring 28 may be selected according to the particular ignition pressures of the particular tactical flight vehicle 10 in which it will be used so that the ignition pressure forces 50 are sufficient to deform the resilient lock ring 28 from the locking configuration to the unlocking configuration upon launch of the tactical flight vehicle.

Figure 10:
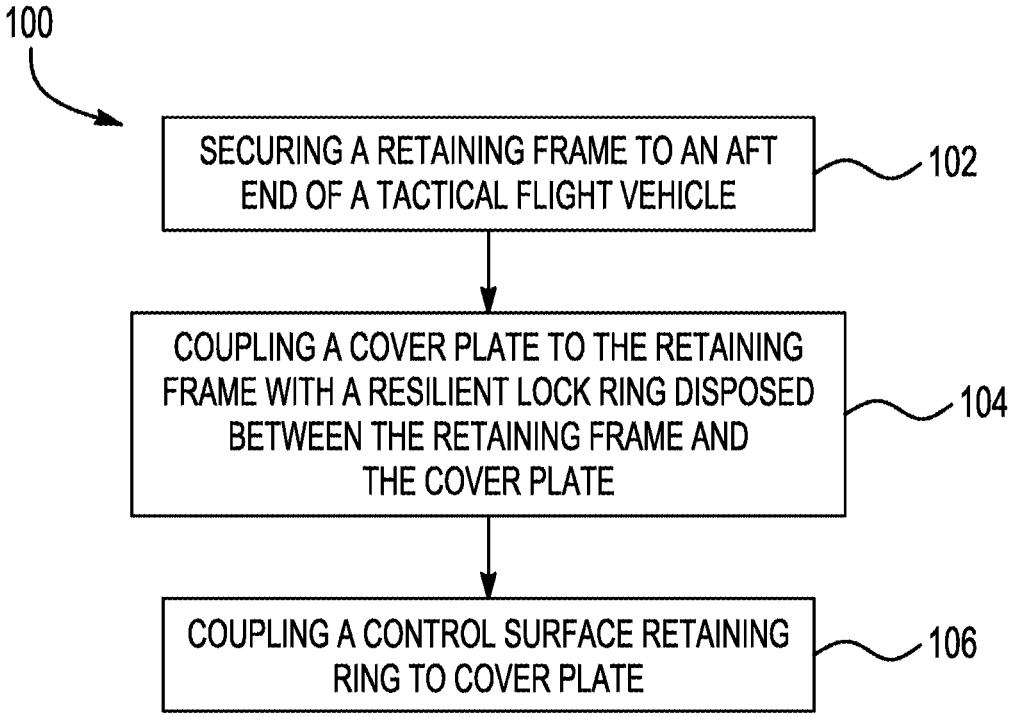
FIG. 10 is a flowchart of a method of restraining one or more control surfaces of a tactical flight vehicle.

With reference to FIG. 10, a method 100 of restraining one or more control surfaces of a tactical flight vehicle is depicted. The tactical flight vehicle may be the same as the tactical flight vehicle 10 described above (FIG. 1). The method 100 includes a step 102 of securing a retaining frame to an aft end of the tactical flight vehicle. The retaining frame may be the same as the retaining frame 22 described above (FIGS. 2A-6). The step 102 of securing may include securing with one or more frame fasteners, such as the one or more frame fasteners 38 described herein (FIG. 5). The method 100 also includes a step 104 of coupling a cover plate to the retaining frame with a resilient lock ring disposed between the retaining frame and the cover plate. For example, the cover plate and resilient lock ring may be the same as the cover plate 24 and the resilient lock ring 28 described above (FIGS. 2A-7). The step 104 of coupling may therefore include installing the resilient lock ring on a radially inner surface of the retaining frame (such as the radially inner surface 22*a* in FIG. 5), and receiving the retaining frame and the resilient lock ring into a retaining frame coupling groove arranged concentrically within a periphery of the cover plate on a first face of the cover plate (such as the retaining frame coupling groove 40 in FIGS. 2B, 5 and 6). The first face of the cover plate opposes the aft end of the tactical flight vehicle, (as described above with reference to the first face 24*a* of the cover plate 24 in FIGS. 2B, 3B, 5 and 6). The resilient lock ring is therefore disposed between the radially inner surface of the retaining frame and a first opposing wall of the retaining frame coupling groove of the cover plate (such as the first opposing wall 40*a* in FIG. 5). The resilient lock ring may also be disposed at least partially in a lock ring groove on the first opposing wall of the retaining frame coupling groove of the cover plate (such as the lock ring groove 42 in FIG. 5).

The method 100 then includes a step 106 of coupling a control surface restraining ring to the cover plate. The control surface restraining ring may be the same as the control surface restraining ring 26 described above (FIGS. 2A-7). The control surface restraining ring therefore has one or more control surface restraints (such as the control surface restraints 34 in FIGS. 2A-7) configured to engage a respective one of the one or more control surfaces of the tactical flight vehicle. The step 106 of coupling the control surface restraining ring to the cover plate may include releasably fastening the control surface restraining ring to the cover plate with one or more restraining ring fasteners. The one or more restraining ring fasteners may be the same as the one or more restraining ring fasteners 32 described above (FIGS. 2A-7). For example, the one or more restraining ring fasteners may include a quick release pull-pin fastener. In this embodiment, the step of releasably fastening includes pulling the quick release pull-pin fastener to permit receipt of the retaining frame and the resilient lock ring into the retaining frame coupling groove, and releasing the quick release pull-pin fastener such that the quick release pull-pin fastener engages a fastening groove on the radially outer surface of the cover plate, thereby coupling the control surface restraining ring to the cover plate.

The method 100 may additionally include a step of installing a seal between a radially outer surface of the retaining frame (such as the radially outer surface 22*b* of the retaining frame 22 in FIG. 5) and a second opposing wall of the retaining frame coupling groove (such as the second opposing wall 40*b* of the retaining frame coupling groove 40 in FIG. 5) of the cover plate such that the seal is disposed at least partially in a seal groove (such as the seal groove 44 in FIG. 6) on the radially outer surface of the retaining frame. The seal may be the same as the seal 30 described above (FIGS. 2A-B, 5 and 6).

Each of the one or more control surface restraints may include a control surface notch, such as the control surface notch 48 of the one or more control surface restraints 34 described above (FIG. 6). The method 100 therefore may further include a step of engaging a respective one of the one or more control surfaces of the tactical flight vehicle with the control surface notch. The method 100 may therefore also include a step of restraining the one or more control surfaces of the tactical flight vehicle within the control surface notch of the one or more control surface restraints.

Although the above disclosure has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments. In addition, while a particular feature may have been described above with respect to only one or more of several illustrated embodiments, such feature may be combined with one or more other features of the other embodiments, as may be desired and advantageous for any given or particular application.

What is claimed is:

1. A control surface restraining system for restraining one or more control surfaces of a tactical flight vehicle, the control surface restraining system comprising:

a retaining frame secured at an aft end of the tactical flight vehicle;

a cover plate releasably coupled to the retaining frame with a resilient lock ring, the cover plate covering the aft end of the tactical vehicle during the launch of the tactical vehicle, and the resilient lock ring being disposed between the retaining frame and the cover plate, wherein the resilient lock ring is deformable between a locking configuration for coupling the cover plate to the retaining frame, and an unlocking configuration for uncoupling the cover plate from the retaining frame; and a control surface restraining ring releasably coupled to the cover plate and having one or more control surface restraints configured to engage a respective one of the one or more control surfaces of the tactical flight vehicle when the control surface restraining ring is coupled to the cover plate and the cover plate is coupled to the retaining frame;

wherein the resilient lock ring is configured to deform from the locking configuration to the unlocking configuration upon a launch of the tactical flight vehicle such that the cover plate becomes uncoupled from the retaining frame and may be jettisoned from the tactical flight vehicle after the launch.

2. The control surface restraining system according to claim 1, wherein the retaining frame is annular and is secured around a periphery of the aft end of the tactical flight vehicle.

3. The control surface restraining system according to claim 1, wherein the retaining frame is secured to the aft end of the tactical flight vehicle with one or more frame fasteners.

4. The control surface restraining system according to claim 1, wherein the cover plate includes a retaining frame coupling groove arranged concentrically within a periphery of the cover plate on a first face of the cover plate, the first face of the cover plate opposing the aft end of the tactical flight vehicle, for receiving the retaining frame when the cover plate is coupled to the retaining frame.

5. The control surface restraining system according to claim 4, wherein the resilient lock ring is disposed between a radially inner surface of the retaining frame and a first opposing wall of the retaining frame coupling groove of the cover plate.

6. The control surface restraining system according to claim 5, wherein the resilient lock ring is disposed at least partially in a lock ring groove on the first opposing wall of the retaining frame coupling groove of the cover plate.

7. The control surface restraining system according to claim 4, further comprising a seal disposed between a radially outer surface of the retaining frame and a second opposing wall of the retaining frame coupling groove of the cover plate.

8. The control surface restraining system according to claim 7, wherein the seal is disposed at least partially in a seal groove on the radially outer surface of the retaining frame.

9. The control surface restraining system according to claim 1, wherein the control surface restraining ring is releasably coupled to the cover plate with one or more restraining ring fasteners.

10. The control surface restraining system according to claim 9, wherein the one or more restraining ring fasteners includes a quick release pull-pin fastener.

11. The control surface restraining system according to claim 1, wherein each of the one or more control surface restraints includes a control surface notch for engaging the respective one of the one or more control surfaces of the tactical flight vehicle.

12. The control surface restraining system according to claim 11, wherein a width of the control surface notch of each of the one or more control surface restraints is greater than a thickness of the one or more control surfaces.

13. The control surface restraining system of claim 1, wherein the tactical vehicle lies along a longitudinal axis, and wherein the cover plate is jettisoned from the tactical vehicle along said longitudinal axis after the tactical vehicle's launch.

14. The control surface restraining system of claim 1, wherein the resilient lock ring has a hoop shape.

* * * * *